US006419018B1

(12) United States Patent
Naquin et al.

(10) Patent No.: US 6,419,018 B1
(45) Date of Patent: Jul. 16, 2002

(54) SUBTERRANEAN WELL COMPLETION APPARATUS WITH FLOW ASSURANCE SYSTEM AND ASSOCIATED METHODS

(75) Inventors: Carey J. Naquin, Youngsville; Terry L. Floyd, Lafayette, both of LA (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/527,799

(22) Filed: Mar. 17, 2000

(51) Int. Cl.[7] ..... E21B 36/00; E21B 43/01; E21B 17/01

(52) U.S. Cl. ..... 166/302; 166/57; 166/304

(58) Field of Search ..... 166/57, 61, 302, 166/304, 311, 312, 369, 350, 367

(56) References Cited

U.S. PATENT DOCUMENTS

| | | | | | |
|---|---|---|---|---|---|
| 2,911,047 | A | | 11/1959 | Henderson | |
| 2,980,184 | A | | 4/1961 | Reed | |
| 3,685,583 | A | * | 8/1972 | Phares | 166/302 |
| 3,721,298 | A | * | 3/1973 | Corbettet et al. | 166/302 |
| 3,880,236 | A | * | 4/1975 | Durning et al. | 166/302 |
| 4,125,289 | A | * | 11/1978 | Huff et al. | 299/4 |
| 4,678,039 | A | * | 7/1987 | Rivas et al. | 166/303 |
| 4,679,598 | A | * | 7/1987 | Jee | 138/103 |
| 5,040,605 | A | | 8/1991 | Showalter | |
| 5,145,289 | A | * | 9/1992 | Titus | 405/169 |
| 5,285,846 | A | | 2/1994 | Mohn | |
| 5,535,825 | A | * | 7/1996 | Hickerson | 166/302 |
| 5,875,852 | A | | 3/1999 | Floyd et al. | 166/387 |
| 6,283,215 | B1 | * | 9/2001 | Kohler et al. | 166/302 |

FOREIGN PATENT DOCUMENTS

| | | |
|---|---|---|
| CA | 1059021 A | 7/1979 |
| CA | 1185519 A | 4/1985 |

* cited by examiner

*Primary Examiner*—David Bagnell
*Assistant Examiner*—Jennifer R. Dougherty
(74) *Attorney, Agent, or Firm*—William M. Imwalle; J. Richard Konneker

(57) ABSTRACT

A subsea subterranean well completion has a tubing string with a portion that extends through a region of the completion exposed to temperatures sufficiently low to potentially create wax and/or hydrate deposits within the tubing string during pre-production or shut-down periods. In order to inhibit or remove the formation of these deposits, the well completion is provided with a flow assurance system operative to create a flow of heating fluid which is recirculated through the space between the tubing string portion and the well casing/production riser structure in a manner causing the heating fluid to flow along the outer side of the tubing string portion without previously or subsequently traversing the interior of the tubing string. The heat absorbed by the tubing string inhibits or removes wax and/or hydrate formation in production fluid therein without the previous necessity of using a chemical injection system to inject plug-inhibiting chemicals into the interior of the tubing string. The flow assurance system may also be used to recirculate or otherwise flow other contact fluids, such as corrosion inhibiting fluids or insulation blanket fluids, against the outer side of the tubing string.

11 Claims, 1 Drawing Sheet

SUBTERRANEAN WELL COMPLETION APPARATUS WITH FLOW ASSURANCE SYSTEM AND ASSOCIATED METHODS

BACKGROUND OF THE INVENTION

The present invention generally relates to subterranean well completion apparatus and, in a preferred embodiment thereof, more particularly relates to subsea subterranean well completion apparatus which is provided with a specially designed flow assurance system that prevents the formation of, or removes, hydrates and wax deposits in the production tubing string without the previous necessity of injecting chemicals into the tubing string.

In deep water well completions, in which the production riser portion of the completion often extends through rather frigid water above the sea bed, potential plugging or restriction of the tubing string due to the formation of hydrates or wax deposits is a major concern. This is especially critical in the production riser interval near the sea floor where ambient temperatures are the coldest. To mitigate this potential problem, it has been common practice to use a subsurface chemical injection system to inject inhibitors and other chemicals into the production tubing string to prevent the formation of the hydrates and/or wax deposits. Examples of such a chemical injection system are schematically depicted in FIGS. 1 and 3 of U.S. Pat. No. 5,875,852 which is hereby incorporated by reference herein in its entirety.

The use of chemical injection systems to inhibit hydrate and/or wax deposit plugging in a production tubing string carries with it several well known problems, limitations and disadvantages. For example, chemical injection systems of this type tend to be quite complex and expensive, entailing various control lines, injector apparatus and related controls. Additionally, associated chemical handling equipment is required at the surface which adds expense and complexity to the completion's surface equipment. Moreover, the chemicals typically injected into the production flow to inhibit hydrate and/or wax plugging or restriction of the production tubing string are typically flammable and/or toxic in nature, thus adding a safety risk to the overall production process.

It can thus be seen from the foregoing that it would be desirable to incorporate in a well completion system of the type generally described a flow assurance system for preventing or removing hydrate/wax plugging or restriction without the use of the injection of chemicals into the production flow. It is to this goal that the present invention is directed.

SUMMARY OF THE INVENTION

In carrying out principles of the present invention, in accordance with a preferred embodiment thereof, a subterranean well completion, representatively an underwater subterranean well completion, is provided with a flow assurance system which is operative to prevent or remove hydrate/wax plugging or restriction of production fluid disposed in a tubing string portion of the completion through which the production fluid may be flowed to the surface. Uniquely, the flow assurance system is operative without the conventional necessity of injecting plug-inhibiting chemicals into the interior of the tubing string.

From a broad perspective, the flow assurance system forms a flow path through which a heated fluid may be recirculated, within the space in the completion apparatus that surrounds the tubing string, in a manner causing the heated fluid to flow along the outer side of the tubing string, thereby transferring heat thereto, without interiorly traversing the tubing string. The flow path may also be used to recirculate other types of fluids in this manner including, for example, a corrosion inhibiting fluid or an insulating fluid.

In an illustrated underwater embodiment of the well completion apparatus which incorporates the flow assurance system, the completion apparatus includes a wellbore extending through the earth through a subterranean production formation, and a production riser extending upwardly from the wellbore through the water. An outer tubing string extends through the production riser and wellbore and forms therewith an outer annular space, and an inner tubing string extends through the outer tubing string and forms therewith an inner annular space. Within the outer tubing string an annular seal structure circumscribes and seals a downhole end portion of the inner string within the outer tubing string. Fluid from the formation is flowable to the surface sequentially through (1) a longitudinal portion of the outer tubing string downhole of the seal structure and (2) the inner tubing string.

An annular packer, set at a subterranean depth at which the temperature is too high to create hydrate or wax deposits in production fluid within the inner tubing string during pre-production or shut-in periods of the completion apparatus, circumscribes the outer tubing string and defines a downhole end of the outer annular space. A sidewall opening is formed in the outer tubing string uphole of the packer and communicates the outer and inner annular spaces.

The outer and inner annular spaces, and the outer tubing string sidewall opening that communicates them, define a flow path through which a selected fluid, such as a corrosion inhibiting fluid or a heated fluid for inhibiting wax and/or hydrate formation in production fluid within the inner tubing string portion above the packer, may be recirculated and caused to flow along the outer side of the inner tubing string without interiorly traversing it. Representatively, a valve, preferably a surface operated sliding sleeve valve, is carried by the outer tubing string and is operative to selectively cover and uncover the sidewall opening therein.

DETAILED DESCRIPTION

Figure 1:
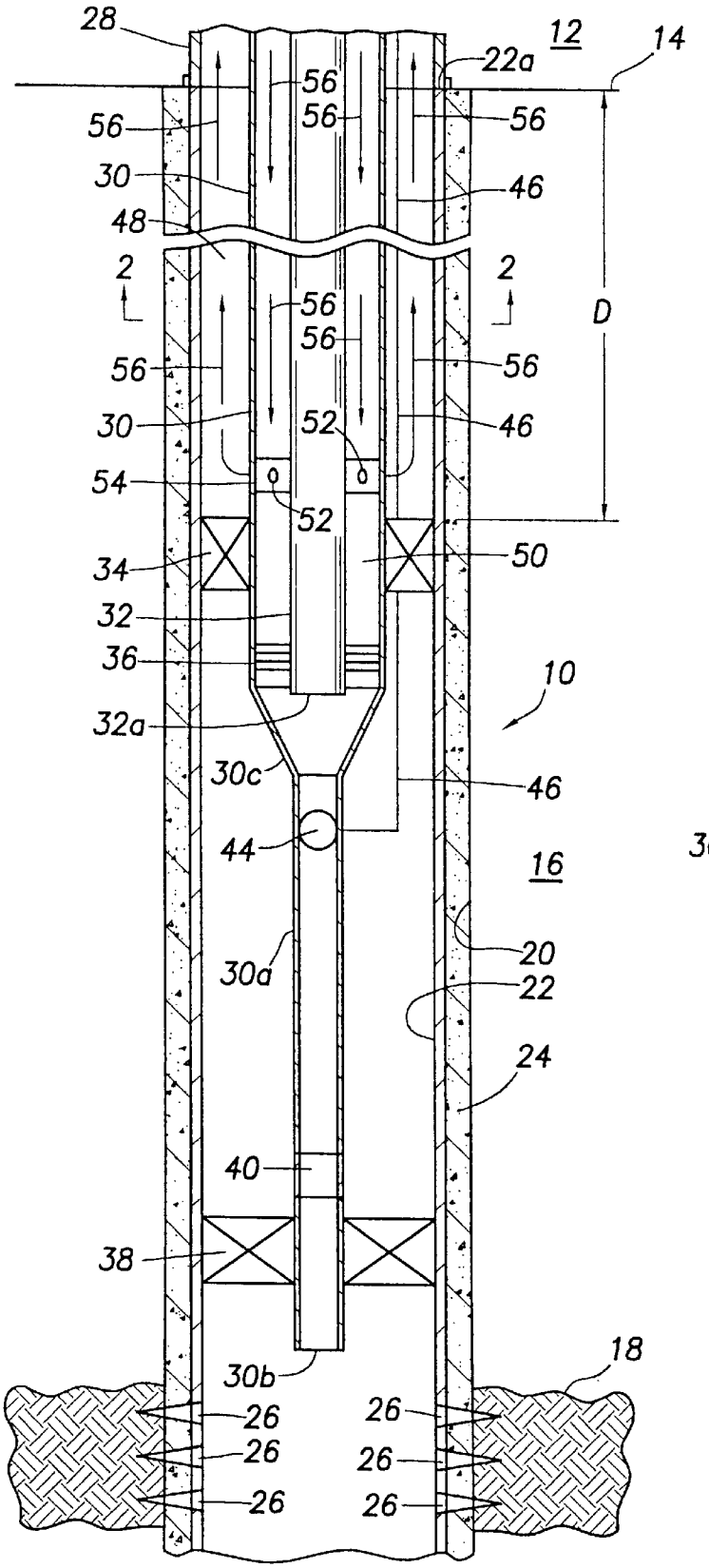
FIG. 1 is a vertically foreshortened horizontally directed schematic cross-sectional view through a portion of a subsea subterranean well completion apparatus having incorporated therein a specially designed flow assurance system embodying principles of the present invention.
Figure 2:
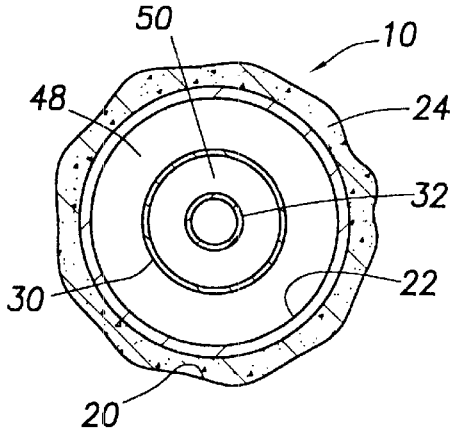
FIG. 2 is a cross-sectional view through the well completion apparatus taken along line 2—2 of FIG. 1.

As schematically depicted in cross-sectional fashion in FIGS. 1 and 2, the present invention provides a subsea subterranean well completion apparatus 10 that embodies principles of the present invention and extends downwardly from a surface platform (not shown), through a substantial depth of sea water 12, downwardly through the sea bed 14 and into the earth 16 to intersect a subterranean production formation 18. In the following description of the well completion apparatus 10, and methods associated therewith, directional terms, such as "above", "below", "upward", "downward", "upper", "lower", etc. are used for convenience in describing the apparatus and methods as they are representatively illustrated in the drawings. Additionally, it is to be understood that the apparatus and associated methods may be utilized in various orientations, including vertical horizontal, inclined, inverted, etc. without departing from the principles of the present invention.

In constructing the representative well completion 10, a wellbore 20 is drilled into the earth 16 to intersect the formation 18 from which it is desired to produce fluid. A liner or casing 22 lines the wellbore 20, and cement 24 is deposited between the wellbore and the casing. It is not necessary to case and cement the wellbore 20 according to the principles of the present invention, since the apparatus 10 may be utilized in conjunction with an open, or partially open, wellbore with suitable modifications, for example, by replacing certain cased hole packers utilized in conjunction with the apparatus 10 with open hole packers, etc. If the wellbore 20 is cased and cemented, perforations 26 are formed in a conventional manner through the casing 22 and cement 24 to permit fluid to flow from the formation 18 into the wellbore 20.

A tubular production riser 28 is suitably tied to the upper end 22*a* of the casing 22 and extends upwardly therefrom to the surface platform. The production riser 28 and the casing 22 outwardly circumscribe an outer tubing string 30 that extends upwardly to the surface platform and has a reduced diameter lower end portion 30*a* disposed below the sea bed 14 and having an open lower end 30*b*. An inner tubing string 32, having a diameter less than that of the outer tubing string 30, coaxially extends downwardly through the outer tubing string 30 from the surface platform and has an open lower end 32*a* positioned adjacent the transition area 30*c* between the larger and smaller diameter portions of the outer tubing string 30.

An annular upper packer structure 34 circumscribes the outer tubing string 30, somewhat above its transition area 30*c* and the lower end 32*a* of the inner tubing string 32, and sealingly engages an annular outer side surface area of the outer tubing string 30 and a facing annular area of the casing 22. A lower end portion of the inner tubing string 32 is sealed within the outer tubing string 30 by a suitable annular seal structure 36 disposed within the outer tubing string 32 between the transition area 30*c* and the upper packer 34.

As illustrated, an open lower end portion of the reduced diameter tubing string section 30*a* is representatively positioned somewhat above the formation 18 and is sealed within the casing 22 by an annular lower packer 38. Operatively installed in the reduced diameter tubing string section 30*a*, just above the lower packer 38, is a landing nipple 40. Representatively, the nipple 40 is similar to the nipple 50 illustrated and described in the aforementioned U.S. Pat. No. 5,875,852 incorporated herein by reference.

A valve 44 is installed in the reduced diameter outer tubing string section 30*a*, between the nipple 40 and the outer tubing string transition area 30*c*, and is of the type which selectively permits or prevents fluid flow axially through the outer tubing string. Preferably, the valve 44 is a conventional surface controlled subsurface safety valve having a fluid pressure control line 46 operatively connected thereto. In a manner similar to that illustrated and described in U.S. Pat. No. 5,875,852, the control line 46 is sealingly extended through the upper packer 34 and to the surface via an outer annulus 48 disposed between the outer tubing string 30 and the casing 22 above the upper packer 34. As illustrated in FIGS. 1 and 2, an inner annulus 50 is disposed between the outer tubing string 30 and the inner tubing string 32.

During fluid production by the completion apparatus 10, fluid from the intersected formation 18 flows inwardly through the perforations 26, upwardly through the reduced diameter outer tubing string section 30*a*, and then upwardly to the platform via the interior of the inner tubing string 32. In its illustrated embodiment, the well completion apparatus 10 (in a manner similar to that illustrated and described in U.S. Pat. No. 5,875,852) provides the enhanced safety capability of allowing the system to effectively isolate the well below the subsea wellhead in the event of a riser system failure.

According to a key aspect of the present invention, the well completion apparatus 10 also includes a flow assurance system that uniquely provides the ability to inhibit or remove paraffin and hydrate blockage or restriction of the interior of the production tubing string 32 either prior to production, or during shutdown periods. As will now be described, this plugging/restriction inhibiting or removing capability of the flow assurance system is provided without the conventional necessity of injecting chemicals or other fluids into the interior of the tubing string 32.

To provide this desirable capability without the use of a costly and complex chemical injection system communicated with the interior of the tubing string 32, the upper packer 34 is set a subterranean distance D beneath the sea bed 14 so that the earth temperature adjacent the packer 34 is sufficient to prevent the formation of wax and/or hydrates in the interior of the inner tubing string 32. The flow assurance system includes side wall openings 52 which are formed in the outer tubing string 30 somewhat above the upper packer 34. While these openings 52 can be utilized by themselves, preferably a valve 54 is associated with the openings 52 and is selectively operable to open and close them. Representatively, the valve 54 is a sliding sleeve valve which may be opened and closed from the surface, similar to a DURASLEEVE® valve manufactured by, and available from, Halliburton Company of Duncan, Okla.

During shut-in or other non-producing periods of the well completion apparatus 10 when hydrates and/or wax deposits could potentially form in production fluid in the interior of the inner tubing string 32 above the upper packer 34, the valve 54 is opened and a flow of contact fluid 56, representatively hot water, is sequentially recirculated downwardly through the annulus 50 and along the outer side surface of the tubing string 32 and the inner side surface of the outer tubing string 30, outwardly through the outer tubing string side wall openings 52 into the annulus 48, and then returned upwardly through the annulus 48 along the inner surface of the casing 22 and the outer side surface of the outer tubing string 30.

This recirculating flow of heated fluid which passes along the outer side surface of the inner tubing string 32, but does not enter its interior, transfers heat to the stagnant production fluid within the tubing string 32 to thereby inhibit plugging or restriction therein by the formation of hydrate and/or wax deposits. When the shut-in period ends, and the normal flow of production fluid is to be resumed, the recirculating flow Of fluid 56 may be terminated, and the valve 54 is returned to its original closed position, thereby permitting the outer tubing string 30 to once again form a closed barrier to contain any production fluid that may have leaked outwardly through a side wall portion of the inner tubing string 32. This same recirculating flow of heated fluid can also remove, by thawing the hydrate plug or melting the wax deposits, via heat transfer, the plug or restriction created from hydrates or wax deposits.

While the recirculated contact fluid 56 is representatively hot water, it may alternatively be another type of heating fluid such as, for example, steam, another type of heated liquid, or a heat-retaining gel material. Also, the fluid 56, instead of being flowed down the inner annulus 50 and then up the outer annulus 48, may be flowed down the outer annulus 48 and then up the inner annulus 50 if desired.

Also, the contact fluid 56 may be a corrosion inhibiting fluid instead of a plug-inhibiting heating fluid. Further, the recirculating flow of contact fluid through the space between the outer side of the tubing string 32 and the casing 22 may be facilitated by a flow assurance structure other than the representatively illustrated concentric tubing string structures 30,32 if desired. For example, in another type of well completion, the outer tubing string structure 30 could be replaced with another tubular structure which was run parallel and to one side of the tubing string 32 and used to flow a contact fluid downwardly between the outer side of the tubing string 32 and the casing 22, discharge the contact fluid upwardly adjacent the upper packer 34, and then recirculate the fluid upwardly along the outer side of the tubing string 32.

Additionally, prior to production from the well completion apparatus, or for relatively short shut-in periods, an insulating fluid, such as a nitrogen blanket or an insulating gel material, may be flowed through the flow assurance system to inhibit the formation within the interior of the tubing string 32 of wax and/or hydrate deposits. The nitrogen or other insulating blanket material may be flowed downwardly through the inner annulus 50, outwardly through the valve openings 52 into the outer annulus 48, and then recirculated upwardly through the outer annulus 48 to captively retain the insulating blanket material within the flow assurance structure. Alternatively, this flow path may be reversed so that the insulating fluid is first flowed downwardly through the outer annulus 48 and then upwardly through the inner annulus 50. Also, with the valve 52 closed, the insulating fluid may be flowed into and captively retained within only the inner annulus 50, or flowed into and captively retained within only the outer annulus 48.

The foregoing detailed description is to be clearly understood as being given by way of illustration and example only, the spirit and scope of the present invention being limited solely by the appended claims.

What is claimed is:

1. For use in an underwater subterranean well completion having a wellbore and being operative to flow production fluid through a first tubing string portion extending through the wellbore and having a longitudinal section disposed in a region having a temperature sufficiently low to potentially cause hydrate and/or wax deposits to form in production fluid within the section, a method of inhibiting the formation of hydrate and/or wax deposits in production fluid in the section, the method comprising the step of recirculating a heated fluid through a portion of the well completion circumscribing the longitudinal section in a manner causing the recirculating heated fluid to flow along the outer side of the longitudinal section without traversing the interior of the first tubing string portion.

2. For use in an underwater subterranean well completion having a wellbore and being operative to flow production fluid through a first tubing string portion extending through the wellbore and having a longitudinal section disposed in a region having a temperature sufficiently low to potentially cause hydrate and/or wax deposits to form in production fluid within the section, a method of inhibiting the formation of hydrate and/or wax deposits in production fluid in the section, the method comprising the step of recirculating a heated fluid through a portion of the well completion circumscribing the longitudinal section in a manner causing the recirculating heating fluid to flow along the outer side of the longitudinal section without traversing the interior of the first tubing string portion, the method further comprising the steps of:

outwardly circumscribing the first tubing string portion with a second tubing string portion in a manner such that a first annular space is defined between the first and second tubing string portions, and a second annular space is defined between the second tubing string portion and the wellbore, forming an annular seal outwardly around an axial section of the first tubing portion within the second tubing string portion, and forming a sidewall opening in the second tubing string portion uphole of the annular seal, the recirculating step being performed by sequentially flowing the heated fluid downhole through one of the first and second annular spaces, through the side wall opening into the other one of the first and second annular spaces, and then uphole through the other one of the first and second annular spaces.

3. The method of claim 2 further comprising the step of mounting a valve on the second tubing string portion, the valve being operative to selectively cover and uncover the sidewall opening.

4. The method of claim 3 wherein the valve mounting step is performed using a sliding sleeve valve.

5. The method of claim 2 further comprising the step of setting a packer around the second tubing string portion downhole of the sidewall opening and at a subterranean depth below the region having a temperature sufficiently low to potentially cause hydrate and/or wax deposits within the first tubing portion section, the packer forming a downhole boundary of the second annular space.

6. Subterranean well completion apparatus comprising:

a wellbore extending through the earth and intersecting a production formation;

a first tubing string extending through the wellbore in an inwardly spaced relationship therewith and through which fluid from the formation may be flowed to the surface; and heating apparatus operative to heat the first tubing string by recirculating a heated fluid through a flow path between the first tubing string and the wellbore in a manner causing the heated fluid to flow along the outer side of the tubing string without traversing its interior, the flow path being defined by:

a second tubing string outwardly circumscribing the first tubing string, a first annular space being defined between the first and second tubing strings, and a second annular space being defined between the second tubing string and the wellbore, an annular seal structure circumscribing an axial portion of the first tubing string and sealing the axial portion within the second tubing string, a sidewall opening formed in the second tubing string uphole of the seal structure, and an annular packer circumscribing the second tubing string, positioned downhole of the sidewall opening, and forming a closed downhole end of the second annular space.

7. The subterranean well completion apparatus of claim 6 wherein:

the second tubing string has a longitudinal section extending in a downhole direction past the packer, and the subterranean well completion apparatus further comprises:

a valve interposed in the longitudinal section of the second tubing string and being operable to selectively permit and preclude fluid flow through the longitudinal section, and a control line connected to the valve and extending axially through the packer.

8. Underwater subterranean well completion apparatus comprising;

a wellbore extending through the earth through a subterranean production formation;

a production riser extending upwardly from the wellbore through the water;

an outer tubing string extending through the production riser and wellbore and forming therewith an outer annular space;

an inner tubing string extending through the outer tubing string and forming therewith an inner annular space;

an annular seal structure sealing a downhole end portion of the inner tubing string within the outer tubing string, fluid from the formation being flowable to the surface sequentially through (1) a longitudinal portion of the outer tubing string downhole of the seal structure and (2) the inner tubing string;

an annular packer circumscribing the outer tubing string and defining a downhole end of the outer annular space;

a sidewall opening formed in the outer tubing string uphole of the packer and communicating the outer and inner annular spaces, the outer and inner annular spaces, and the outer tubing string sidewall opening that communicates them, defining a flow path through which a heated fluid for inhibiting or removing wax and/or hydrate formation in production fluid within the inner tubing string, may be recirculated and caused to flow along the outer side of the inner tubing string; and heating apparatus operative to flow heated fluid through the flow path.

9. The underwater subterranean well completion apparatus of claim 8 further comprising:

a valve carried by the outer tubing string and operative to selectively cover and uncover the sidewall opening.

10. The underwater subterranean well completion apparatus of claim 9 wherein the valve is a sliding sleeve valve.

11. For use in an underwater subterranean well completion having a wellbore and being operative to flow production fluid through a first tubing string portion extending through the wellbore and having a longitudinal section disposed in a region having a temperature sufficiently low to potentially cause hydrate and/or wax deposits to form in production fluid within the section, apparatus for inhibiting the formation of hydrate and/or wax deposits in production fluid in the section, the apparatus comprising means for recirculating a heated fluid through a portion of the well completion circumscribing the longitudinal section in a manner causing the recirculating heated fluid to flow along the outer side of the longitudinal section without traversing the interior of the first tubing string portion.

* * * * *